US011305564B2

(12) United States Patent
Fernandez Vazquez et al.

(10) Patent No.: US 11,305,564 B2
(45) Date of Patent: Apr. 19, 2022

(54) MACHINE AND METHOD FOR MULTI-PASS DIGITAL PRINTING ON GLASS SHEETS WITH MINIMISED PRINT TRAVEL

(71) Applicant: TECGLASS, S.L., Lalin (ES)

(72) Inventors: Juan Javier Fernandez Vazquez, Lalin (ES); Alberto Alvarez Flores, Lalin (ES)

( * ) Notice: Subject to any disclaimer, the term of this patent is extended or adjusted under 35 U.S.C. 154(b) by 0 days.

(21) Appl. No.: 16/490,535

(22) PCT Filed: Feb. 28, 2018

(86) PCT No.: PCT/ES2018/070150
§ 371 (c)(1),
(2) Date: Aug. 31, 2019

(87) PCT Pub. No.: WO2018/158483
PCT Pub. Date: Sep. 7, 2018

(65) Prior Publication Data

US 2020/0001639 A1 Jan. 2, 2020

(30) Foreign Application Priority Data

Mar. 1, 2017 (ES) ..... ES201730277

(51) Int. Cl.
*B41J 25/00* (2006.01)
*B41J 2/145* (2006.01)
*B41J 2/15* (2006.01)
*B41M 5/00* (2006.01)

(52) U.S. Cl.
CPC ..... *B41J 25/001* (2013.01); *B41J 2/145* (2013.01); *B41J 2/15* (2013.01); *B41J 25/006* (2013.01); *B41M 5/007* (2013.01)

(58) Field of Classification Search
CPC . B41J 2/145; B41J 2/15; B41J 25/006; B41M 5/007
See application file for complete search history.

(56) References Cited

U.S. PATENT DOCUMENTS 8,118,386 B2 * 2/2012 Kojima ..... B41J 2/15 347/12

* cited by examiner

*Primary Examiner* — Geoffrey S Mruk
(74) *Attorney, Agent, or Firm* — Furr Law Firm; Jeffrey Furr, Esq.

(57) ABSTRACT

Machine and method for multi-pass digital printing of plate glass with minimization of print travel. The machine is configured to recognize the longest dimension of the motif to be printed in the X and Y directions and to execute the multiple print passes by moving the bridge in the X direction or by moving the carriage along the bridge in the Y direction.

6 Claims, 5 Drawing Sheets

PRIOR ART

Fig. 3-A
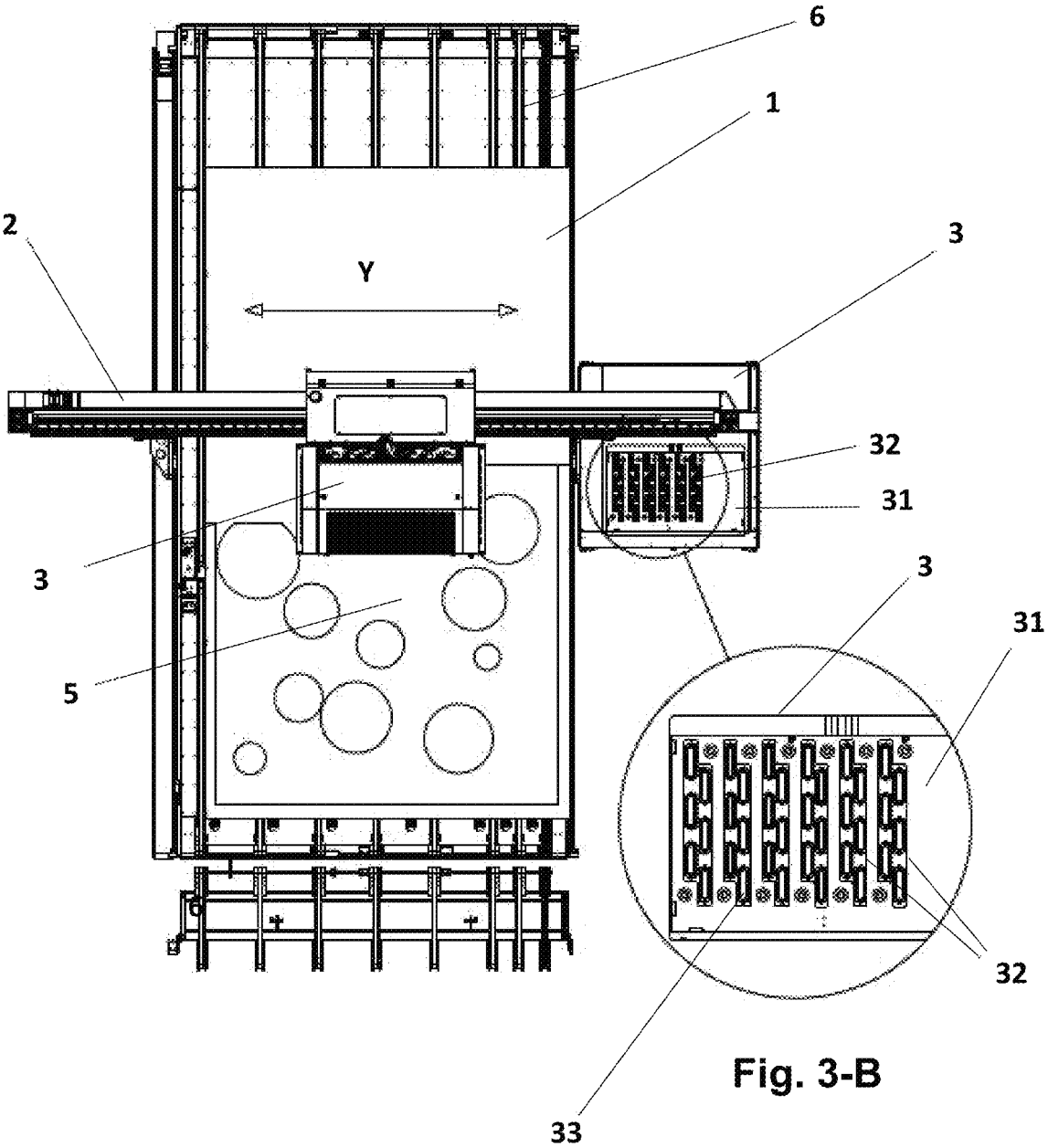
Fig. 3-B

Fig. 4-A
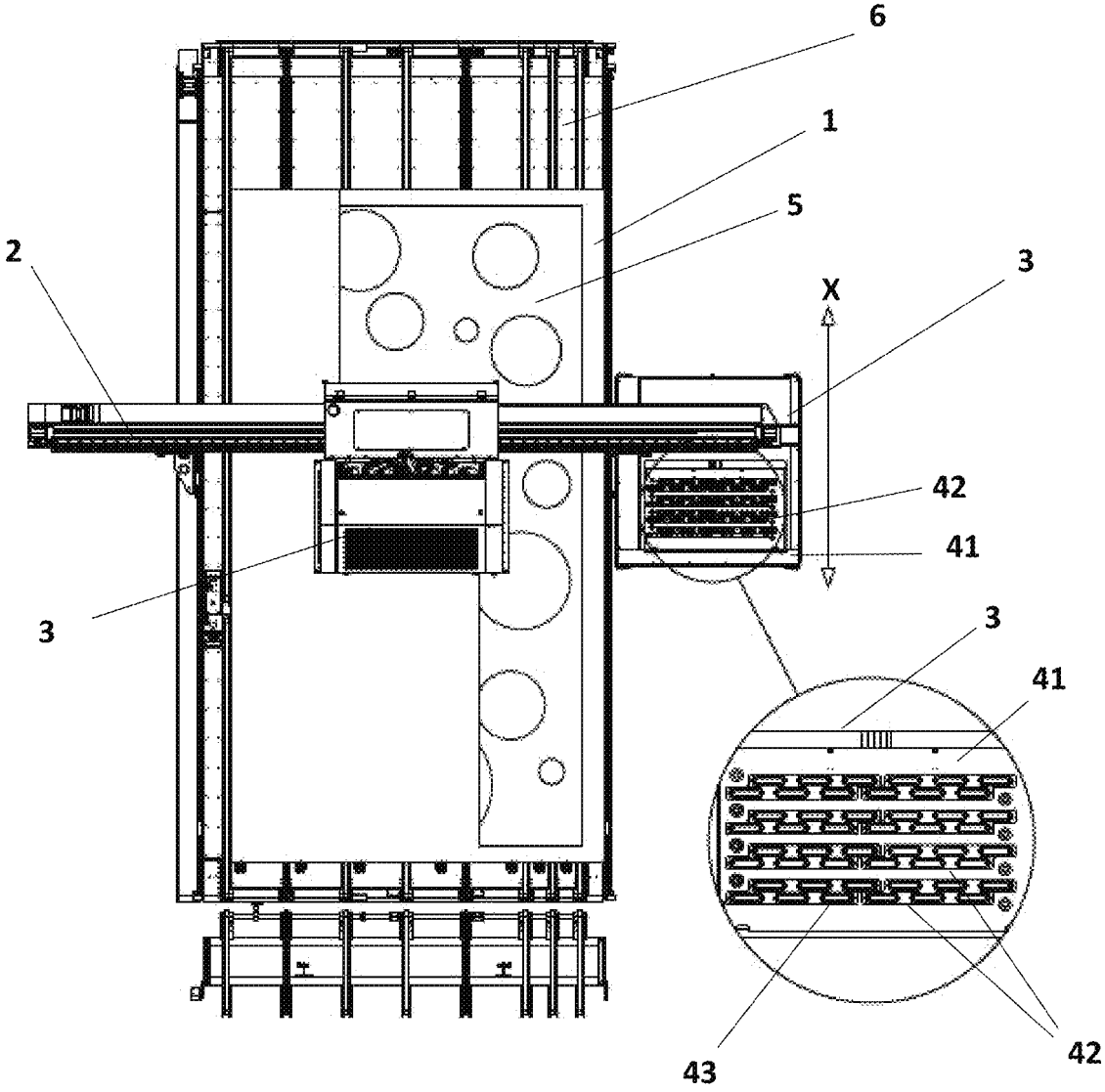
Fig. 4-B

Fig. 5-A
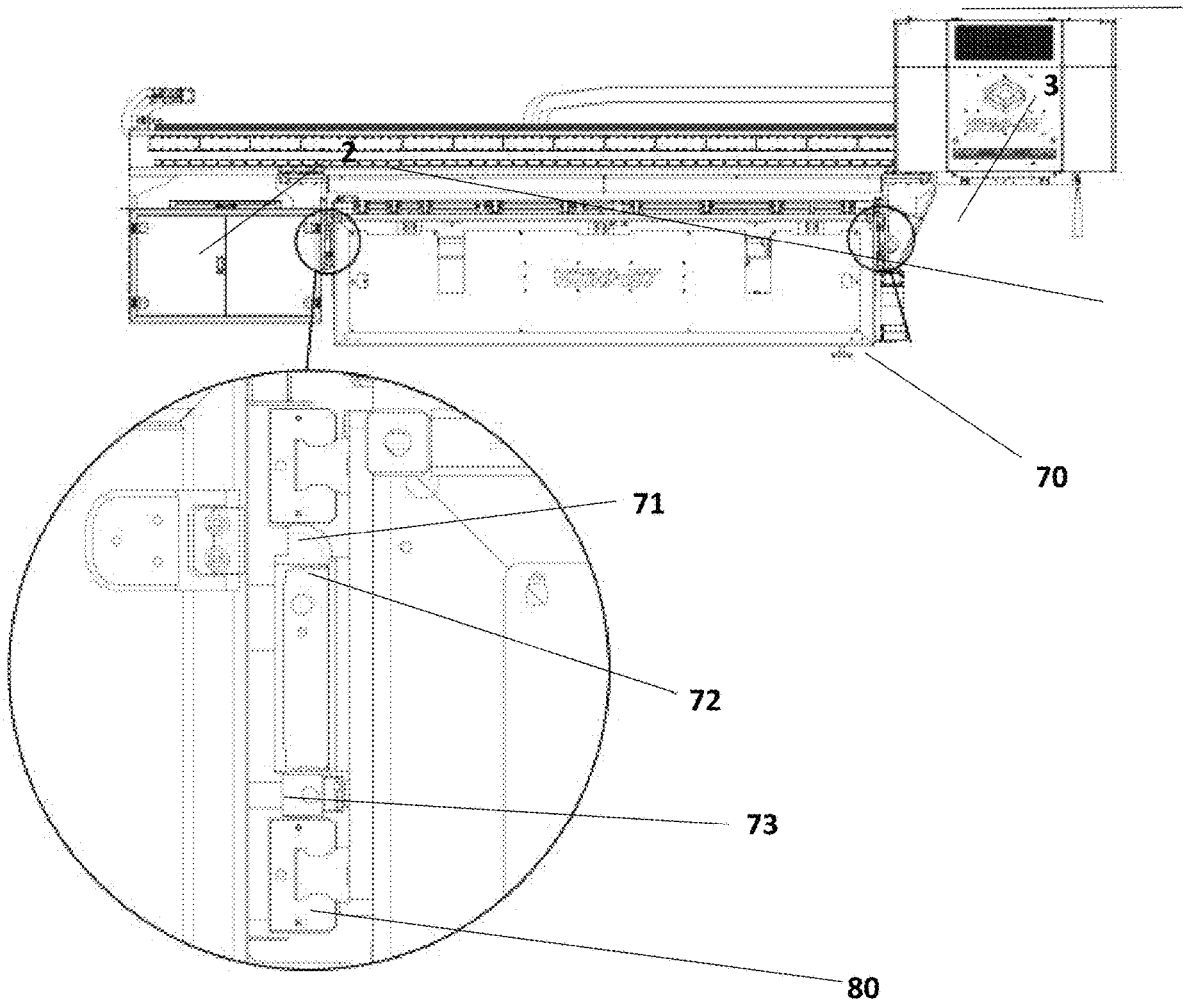
Fig. 5-B

MACHINE AND METHOD FOR MULTI-PASS DIGITAL PRINTING ON GLASS SHEETS WITH MINIMISED PRINT TRAVEL

SUBJECT MATTER OF THE INVENTION

This invention is found in the prior art of digital printing machines that decorate plate glass.

This invention is particularly useful for printing on plate glass that is rectangular or that comes in different shapes, but particularly for elongated and/or narrow plates of glass.

BACKGROUND OF THE INVENTION

In the prior art, machines for digital printing on glass are often multi-pass machines comprising a print carriage that moves along a bridge situated over the "X" passage of a sheet of glass that is situated and moves on a table (see patent ES2.337.829T3), and said bridge (and therefore the "Y" movement of the print carriage) is transverse or perpendicular to the "X" passage of the glass to be printed on, as described in patent ES2.396.532. Also known is the technology in which the bridge moves in the "X" direction (with transverse movement "Y" of the print carriage) while the glass is held in a fixed position. In these cases, there is a print carriage that has to print the glass in several passes, with said carriage moving the length of the bridge that supports it. These machines are commonly referred to as multi-pass, or multipass, because, broadly speaking, they print in the following way: the glass is placed in the print position and the bridge moves in the "X" direction to the glass (or the glass is moved in the "X" direction on the table until the part to be printed is under the bridge). The print carriage begins to move the length of the "Y" direction of the bridge while it prints on the glass (making one pass over the glass). Next, the glass, or the bridge, moves in the "X" direction a distance equivalent to the width of the print head, and the carriage makes another print in the "Y" direction, and so on, until it finishes the print on the glass to be printed. There are variations of multi-pass printing such as the one described in patent EP2631077.

The machine subject matter of patent application ES201531665 incorporates a print bridge that can move while printing along the X axis or direction (longitudinal axis of the machine). This bridge supports means of digital printing with printing bars with a succession of print heads that occupy the width of the glass to be printed on. Therefore, it is a single-pass printing machine, not a multi-pass one.

The machine subject matter of patent application ES201630555 describes (as a simpler alternative to the invention subject matter of Spanish patent ES201431460 for the printing of perimeter edges on rectangular or multi-shaped plate glass) a machine whose print carriage presents: a main support that holds a main series of print modules, and an auxiliary support with an auxiliary series of print modules; wherein said main and auxiliary series are disposed perpendicularly, with the auxiliary series of print modules printing the perimeter edges in the X direction of the plate glass (either by movement of the bridge in the X direction, or if the support structure of the machines allows it, by the movement of the plate glass in the X direction with the bridge (and carriage) static). The main series of print modules prints the perimeter edge in the Y direction of the plate of glass by moving the print carriage on the bridge of the machine.

Finally, patent WO2017068459 offers a printing method and a machine that prints in a direction parallel to the advancement of the plate glass or ceramic. For this, it includes a bridge that is also disposed parallel to the advancement, which necessitates very large gantries. The weight of the head (several tens of kilograms) produces deformations of the bridge that increase the positional error, therefore the precision of the printing is very limited. As a consequence, it is only applicable for very small formats and lacks versatility.

DESCRIPTION OF THE INVENTION

With the machine subject matter of this invention, printing is done by moving the bridge along the X axis or direction (longitudinal axis of the machine, and perpendicular to the Y axis or longitudinal axis of the bridge supporting the print carriage). Therefore, the printing machine and methods subject matter of this invention go beyond patent application ES201630555 cited previously, wherein the printing is only done on the perimeter edges of the glass. Thus, when the X side (or reference dimension X) in the X direction of the glass to be printed on, or on the X direction of the motif to be printed, is longer than the Y side (or reference dimension Y) in the Y direction, the printing is produced by the movement of the bridge in the X direction (instead of making multiple passes of the carriage along the bridge (Y direction)) with movement of either the glass, or the bridge (X direction) between one pass and another pass of the carriage, as is known in the prior art of multi-pass printing machines).

In the printing machine subject matter of this invention, the bridge (X direction) moves in a precise way controlled by two motors (instead of one). The motors are each situated on either side of the printing machine. Both motors are linked to a high-precision micrometric encoder to make the bridge move with extreme precision, and to not lose parallelism during the successive passes. Both motors are controlled by a movement controller.

The digital printing machine subject matter of this invention presents a structure to hold the glass by means of automatic positioning for the positioning and bracing of a sheet of glass during the printing, means of expelling the sheet of glass, and means of transporting the glass when no printing is happening. The machine subject matter of this invention also presents:

A print bridge that can move in the X direction. This bridge is controlled, as mentioned previously, by two servo-controlled motors and a high-precision micrometric encoder for each one so that the movements are controlled micron-by-micron for both motors.

A print carriage supported by said bridge, movable the length of said bridge (Y direction).

A central device for data processing and control configured to order the printing with multiple passes along the X or Y direction corresponding to the longest X' or Y' reference dimension (maximum print reference or movement dimensions in the X and Y directions).

The data of said dimensions, or the indication, calculation or recording of the longest dimension can be done in various ways: manually; through an artificial vision system, or by reading a data file with the data of the figure to be printed. Therefore, this central processing and control device has the means to receive data about the dimensions and colors of the motifs to be printed, be it manually or via a data download from a data medium or a telematic data network.

This central unit for the processing and control of said position data (X,Y) and parameters (&(x,f(x)) of the plate of glass can have a module for receiving the data of the artificial vision device, a piece of software for processing said data and determining the position information of the print heads on the "Y" coordinate (Y=f(X)) corresponding to each ordinate ("X"), and a module for sending print signals to the print heads based on the information determined by said software.

It can also incorporate means of artificial vision configured to recognize the outline F(x,y) of the plate to be printed on I, to prevent it from printing outside the outline. They can be configured to automatically capture and send the position data (X,Y) of the plate glass and the curve (&(x,f(x)) of the exterior and interior perimeters of said plate glass.

As regards the digital print carriage of the machine subject matter of this invention, this presents:

On the one hand, a main support (which may be removable) of a main series of print modules (at least one print module) orientated to print in the X direction (this happens as the print bridge moves to execute a print) with at least one print module. Therefore, if there are several print modules in the series, these are aligned in the same printing direction (direction X), with each print module incorporating at least one print head (for example, such as those of patent application ES201630555 by the same inventor) with one color (each module of the series may have a different color).

Therefore, the carriage is configured with heads orientated to print during the bridge's movement along the X direction.

On the other hand, the carriage may also incorporate an auxiliary support (which may be removable) to which an auxiliary series of print modules is fixed in the Y direction (this happens as the print carriage moves to execute a print) with at least one print module. When there are several print modules in the auxiliary series, these are aligned in the same printing direction (direction Y). The print modules of both series, main and auxiliary, may be identical in structure and configuration (as described in patent application ES201630555, by the same inventor, whose detailed description is incorporated by reference).

When the carriage incorporates both auxiliary and main supports, these are joined yet remain separate. A type of mount may be chosen that allows the removal and mounting of the auxiliary support on the main support of the print carriage (i.e., the printing machine could therefore print with or without said auxiliary support fitted). The auxiliary series of print modules and said main series are configured on the same working plane, forming part of the same print carriage; and, as a consequence of the description further above, said auxiliary series of print modules is disposed perpendicularly to the main series.

The machine incorporates a device for vertical movement of the carriage (for example, a vertical-axis-servo joined to said support plate parallel to the print bridge) to the print position, or to positions after the movement of the carriage beyond the printing operation.

It should be remembered that the installation of a main support and an auxiliary one corresponds to the optimal configuration of the machine, enabling it to print, both to the bridge and the carriage, depending on the direction of maximum movement per pass. However, the auxiliary support may be dispensed with, so that the machine would only print in the X direction by movement of the bridge. If only the main support is dispensed with, we would find ourselves with a multi-pass printing machine such as those existing in the prior art.

The printing method subject matter of this invention, which is executed with the machine subject matter of this invention, presents the following stages:

The data (X",Y") of the figure to be printed and its colors (X'",Y'") are entered into the means for receiving data.

The machine (for example, through the artificial vision system) recognizes which of the reference dimensions (X', y') in the X and Y direction of the plate to be printed on is greater; alternatively, the data of the reference dimensions (X',Y') may be those of the longest dimensions of the figures to be printed on the plate. Alternatively, the data of said dimensions, or signaling of the longest dimension can be provided manually or by reading a data file with the data of the figure to be printed.

The central processing and control device prints the multiple passes along the X' or Y' dimension that is the longest.

Thus, if the longest dimension is X', the print passes are made by the print bridge when printing with heads supported by the carriage's main support. When a complete pass is made, the carriage moves one width of the pass, and then the next pass of the bridge is made. Therefore, printing is done during the movement of the bridge.

Conversely, if the longest dimension is Y', the print passes are executed by the carriage via its movement along the bridge, and printing with the heads supported by its auxiliary support. When the carriage makes a complete pass, then the bridge (or alternatively the glass) moves in the X direction one pass width so that the carriage will then make the next pass.

The means of artificial vision recognizes the outline F (x,y) of the plate to be printed on, preventing it from printing outside the outline.

This invention achieves a significant time saving in printing on the narrow and long pieces of glass that are trending greatly in the industry. In addition, this machine is able to optimize the management of data transmission to the print heads because, in each pass, information is sent in real time to the heads or to the intermediate memory. Therefore, with this invention, the number of passes is minimized.

This machine is preferably applicable to prints of the whole piece (not for advantageous printing of perimeter edges such as in patent application ES201630555).

Therefore, this invention is especially useful to give a quick, effective and improved response to the prior art, optimizing the directions of the print passes based on the disposition of the print sheets to be printed.

BRIEF DESCRIPTION OF THE FIGURES

FIG. 3-A: top plan view of a multi-pass machine of the prior art with movement of the carriage along the bridge making the passes of FIG. 1. Seen in this figure are both the top plan view of its print carriage during the execution of a print, and the bottom plan view of said carriage when removed from the bridge.

FIG. 3-B: close-up of the bottom plan view of the print heads in the carriage of FIG. 3-A.

FIG. 4-A: top plan view of a machine subject matter of this invention with a print carriage with main support making the passes of FIG. 2. Seen in this figure are both the top plan view of its print carriage during the execution of a print, and the bottom plan view of said carriage when removed from the bridge.

FIG. 4-B: close-up of the bottom plan view of the print heads in the carriage of FIG. 4-A.

Seen in FIGS. 5-A and 5-B, respectively, are a front plan view of FIG. 4-A and a close-up view of the motors controlling the printing movement of its bridge.

PREFERRED EMBODIMENT OF THE INVENTION

Details of an embodiment of this invention are given below.

Figure 1:
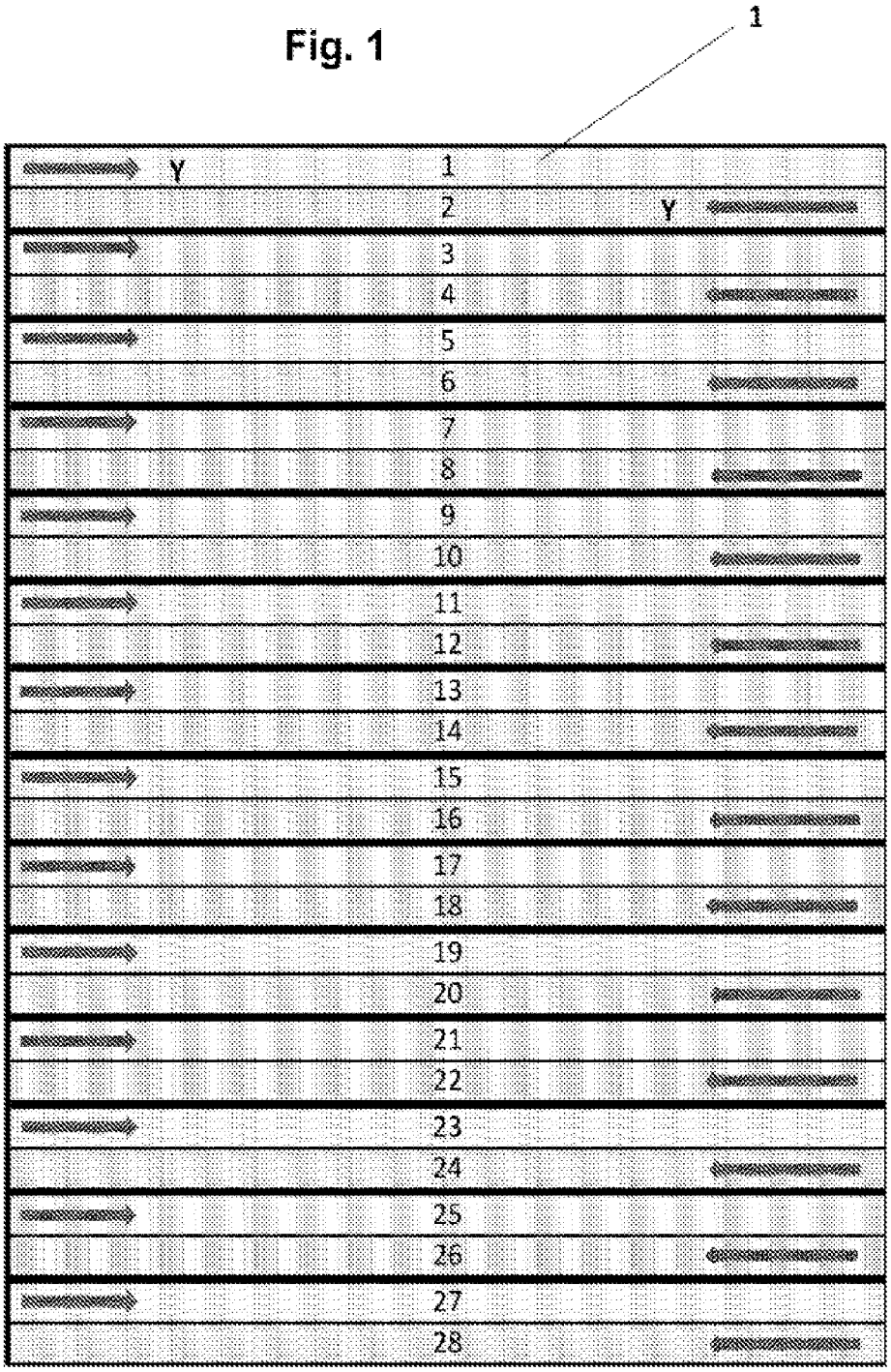
FIG. 1: representation of the print passes with a multi-pass printing machine of the prior art in which the carriage moves along the bridge.

FIG. 1 shows the travel to be made by a prior-art printing machine with movement of a plate of glass (1) in the X direction, and movement of the carriage along the longitudinal axis of the print bridge in the Y direction. It is observed that, for a rectangular plate of glass measuring 6-meters long (in the X direction) by 1-meter wide, where each print pass is 70-mm wide, it would require 86 passes (marked in FIG. 1 as passes: 1, 2, 3, 4 through 28 to simplify the figure) to print the entire surface of said plate (86 passes in the Y direction×70 cm in width=6020 mm to cover the 6-meter length of the plate). If each pass takes 5 seconds, the total printing time would be 430 seconds (print speed of 330 mm/s plus+2 seconds of booting for each pass).

Figure 2:
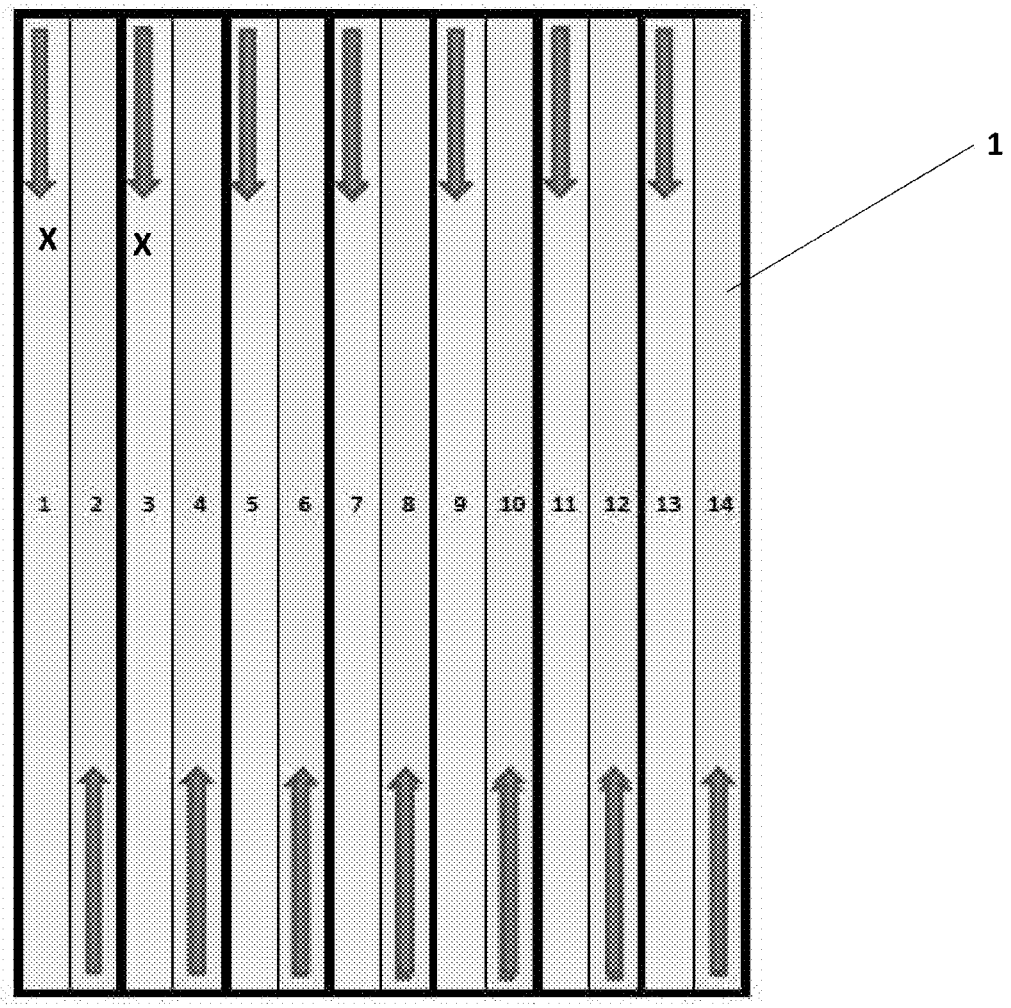
FIG. 2: representation of the print passes with the machine subject matter of this invention in which the printing occurs through passes produced by the movement of the bridge.

FIG. 2 shows the travel which, on the plate of glass (1) of FIG. 1, is executed with an embodiment of the machine subject matter of this invention in which the bridge moves while a 70-mm-wide pass is made, requiring only 14 passes (marked in FIG. 2 as passes: 1, 2, 3, 4 through 14). The previous speed takes 20 seconds per pass, resulting in 280 seconds for the complete print, that is, 35% less time than in that of FIG. 1.

FIG. 3-A shows the support structure (6) of a multi-pass printing machine, known in the prior art, supporting a plate of glass (1) on which a motif (5) is being printed by the print heads (33) of the print modules (32) of the print support (31) of the print carriage (3) (see FIG. 3-B). The print carriage (3) is supported and is movable by multiple passes in the Y direction along the bridge (2) while it prints the motif (5).

FIG. 4-A shows the support structure (6) of a preferred embodiment of the multi-pass printing machine subject matter of this invention supporting a plate of glass (1) on which a motif (5) is being printed by the print heads (43) of the print modules (42) of the print support (41) of the print carriage (3) (see FIG. 4-B). The print carriage (3), supported by the bridge (2), is moved by multiple passes in the X direction by the movement of the bridge (2) while it prints the motif (5).

FIG. 5-A shows the printing machine with the print carriage (3), the bridge (2), and the two motors (70) (on each side of the machine, which control the print movement of its bridge (2). FIG. 5-B shows a close-up view of one of the two motors (70) with the movement rails (71) on some guides (72) fixed to the structure of the machine, the coil (73), and the encoder (80). These two motors that move the bridge precisely are, for example, of the linear type, made by Tecnotion®, model TB30. Procedure and printing machine on rigid substrate.

The invention claimed is:

1. Multi-pass printing machine for plate glass with minimization of print travel of the kind that comprises a fixed structure to hold the glass by means of automatic positioning for the positioning and bracing of a sheet of glass during the printing, means of expelling the sheet of glass, and means of transporting the glass when no printing is happening, a print bridge disposed perpendicularly to the direction in which the plate advances wherein the print bridge can move in the X direction, a print carriage supported and configured to move along said bridge (Y direction) wherein the print carriage is configured with heads orientated to print during the bridge's movement along the X direction, and a central print processing and control unit, wherein: said print carriage comprises a main support with at least one print module oriented in the X direction, perpendicular to said Y direction, wherein said print module is fed by a colored ink, and said print module comprises at least one print head; said machine also comprises two motors, each motor including a high-precision micrometric encoder, said motors configured to control the movement of said bridge in the X direction; and a central unit configured to simultaneously order the movement of the bridge in the X direction, and the printing by said print heads.

2. Multi-pass printing machine, according to claim 1, wherein said central unit comprises: means for receiving data about the reference dimensions (X',Y') in the X and Y directions of the plate to be printed on; a piece of software for processing said data and determining the position information of the print heads on the "Y" coordinate (Y=f(X)) corresponding to each "X" ordinate; a module for transmitting the print signals to the print heads based on the information determined by said software; and, wherein: said carriage comprises an auxiliary support configured on the same working plane as said main support, with said auxiliary support comprising at least one print module oriented in the printing direction of the Y direction, and said print module is fed by ink of one color and comprises at least one print head, and such central unit is configured to simultaneously order, based on the greater of the reference dimensions X' and Y', the movement of the bridge in the X direction and the printing of the heads of the main support of the carriage; or alternatively, to simultaneously order the movement of the carriage in the Y direction and the printing, via the print heads, by the auxiliary support of the carriage.

3. Multi-pass printing machine according to claim 2, wherein both auxiliary and main supports are fixed together yet separately, and are configured to be removable, and said machine comprises a device for vertical movement of the carriage to the printing position.

4. Multi-pass printing machine according to claim 3, whereby an artificial vision system is included to recognize the data of two reference dimensions (X',Y') of the plate.

5. Multi-pass printing machine according to claim 2, whereby an artificial vision system is included to recognize the data of two reference dimensions (X',Y') of the plate.

6. Multi-pass printing machine according to claim 1, whereby an artificial vision system is included to recognize the data of two reference dimensions (X',Y') of the plate.

* * * * *